US008120628B2

(12) United States Patent
Chen et al.

(10) Patent No.: US 8,120,628 B2
(45) Date of Patent: Feb. 21, 2012

(54) METHOD FOR DRIVING A DISPLAY

(75) Inventors: Ke-Horng Chen, Taipei County (TW); Chun-Ho Chen, Changhua County (TW); Shian-Jun Chiou, Taipei (TW); Han-Ping Shieh, Hsinchu (TW); Ti-Ti Liu, Taipei (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 1008 days.

(21) Appl. No.: 12/050,961

(22) Filed: Mar. 19, 2008

(65) Prior Publication Data

US 2008/0266312 A1 Oct. 30, 2008

(30) Foreign Application Priority Data

Apr. 27, 2007 (TW) ..... 96115046 A

(51) Int. Cl.
*G09G 5/10* (2006.01)

(52) U.S. Cl. ..... 345/690; 345/56; 345/58; 345/61; 345/214; 345/696; 382/236; 382/266; 348/612; 348/615

(58) Field of Classification Search ..... 345/696; 348/612; 386/266
See application file for complete search history.

(56) References Cited

U.S. PATENT DOCUMENTS

| | | | | |
|---|---|---|---|---|
| 5,428,366 | A | 6/1995 | Eichenlaub | |
| 6,078,304 | A | 6/2000 | Miyazawa | |
| 6,570,554 | B1 | 5/2003 | Makino et al. | |
| 6,911,963 | B2 * | 6/2005 | Baba et al. | 345/88 |
| 7,025,464 | B2 * | 4/2006 | Beeson et al. | 353/98 |
| 7,952,549 | B2 * | 5/2011 | Lee et al. | 345/88 |

FOREIGN PATENT DOCUMENTS

TW 494686 7/2002

* cited by examiner

*Primary Examiner* — Antonio Caschera
(74) *Attorney, Agent, or Firm* — Jianq Chyun IP Office

(57) ABSTRACT

A method for driving a display is provided. According to the driving method, a display panel is divided into a plurality of bright regions and a plurality of dark regions, wherein the dark regions and the bright regions are alternately arranged so that the bright regions within the display panel are not adjacent to each other. Next, a full-color frame is divided into four sub-frames, wherein the sub-frames are matched with the four color-orders one by one. In this way, the display randomly displays the sub-frames in a frame period.

9 Claims, 11 Drawing Sheets

METHOD FOR DRIVING A DISPLAY

CROSS-REFERENCE TO RELATED APPLICATION

This application claims the priority benefit of Taiwan application serial no. 96115046, filed on Apr. 27, 2007. The entirety of the above-mentioned patent application is hereby incorporated by reference herein and made a part of this specification.

BACKGROUND OF THE INVENTION

1. Field of the Invention

The present invention generally relates to a method for driving a display, and more particularly, to a method for driving a display using a color sequential method.

2. Description of Related Art

Along with the development of photoelectric and semiconductor technology, the flat panel display technology is also being rapidly developed and has made significant progress. Among various displays, a liquid crystal display (LCD) has played a major role in the mainstream display market due to advantages of low power consumption, no radiation and low electromagnetic interference thereof. An LCD includes an LCD panel and a backlight module. The backlight module provides the LCD panel with a planar light source so as to make an LCD panel have display function.

The backlight module of a conventional LCD is a white light source, which emits white light passing through color filters to serve as a backlight source of the LCD panel. At each pixel positioned on the LCD panel, three color filters including a red filter, a green filter and a blue filter are disposed. Thus, this arrangement would incur higher cost and causes a color-blending problem at all boundaries between any two of the color filters. Although disposition of a black matrix at any adjacent position between the red, green and blue filters can decrease the color-blending problem, the solution would make the optical transmittance of the color filters poor.

Based on the above-mentioned problems, a display-driving technique by using a control circuit in association with a color sequential method was developed, wherein the display-driving technique uses the light-emitting diodes (LED) to replace the traditional white backlight source. Instead of the prior art where color filters are used to make any three sub-pixels localized within a tiny dimension (less than a viewing-angle resolution of human eyes) color-blended, the technique uses an LED backlight source to sequentially accomplish color-blending (within the duration of persistence of human eye's vision, three color images, i.e. red, green and blue color images, are quickly switched to achieve color-blending effect). It can be seen that the display technique does not need a color filter and promotes the optical transmittance of the display panel.

Although the display-driving technique by using a control circuit in association with the color sequential method is able to promote the optical transmittance of the display panel and effectively reduce the flaw in a display using color filters. However new problems, for example a color breakup (CBU) problem associated with the technique have been identified. Due to human eye's random saccades or the instinct of pursuing the object on screen frame, in terms of visual perception, the color fields corresponding to each color of an object on a frame do not fall onto a same point of human eye's retina, therefore, a color breakup occurs at edges of an object on a screen frame.

FIG. 1A is a diagram showing a color breakup phenomenon. Referring to FIG. 1A, to complete displaying a full-color frame by using the color sequential method in the prior art, a frame is completed by four sequentially displayed sub-frames with three colors, and the red sub-frame R, the green sub-frame G and the blue sub-frame B are quickly and sequentially displayed to produce a full-color image. Taking a white image W as an example, a white image 110 observed by a moving observing point would have a left edge with blue color (B) and a combination of blue color plus green color (B+G) and a right edge with red color (R) and a combination of red color plus green color (R+G), both of which are not desired edges with white color (W).

Based on the above-introduced background, some schemes to improve the color breakup were accordingly proposed. For example, the Taiwan patent publication No. 494686 proposes a scheme to perform image processing and dynamic compensation on a full-color frame by using motion-compensation, and to eliminate color breakup by predicting motions of an object on screen frame. Another scheme provides a display flowchart of a conventional driving method shown by FIG. 1B. According to the flowchart, a full-black frame is added between any two color-sequences; that is a black sub-frame is added after showing a red sub-frame R, a green sub-frame G and a blue sub-frame B so as to make a red sub-frame, a green sub-frame, a blue sub-frame and a black sub-frame display in sequentially cycling mode to reduce color breakup. Yet another scheme provides a display flowchart of a conventional driving method shown by FIG. 1C, wherein color-sequences are altered to reduce the human-eye effect. For example, a first full-color frame F1 is composed of three sub-frames sequentially arranged in the order of red (R), green (G) and blue (B), while the second full-color frame F2 is composed of three sub-frames sequentially arranged in the order of blue (B), red (R) and green (G).

However the above-described methods for driving a display targeting to reduce color breakup is not faultless. In terms of the scheme of compensating motion, the additional operations of image processing and dynamic compensation are required, in particular, it is hard to predict the motions of an object on the screen. In terms of the scheme of inserting black sub-frames or altering color-sequences, it is a limitation of the scheme that all the processing targets a whole frame, which helps to reduce the human eye's perception of color breakup to a limited extent only.

SUMMARY OF THE INVENTION

Accordingly, the present invention is directed to a method for driving a display to promote optical transmittance of display panel by disturbing the regular color-sequence and altering the regular color arrangement order and further to make the displayed colors more vivid.

The present invention is also directed to a method for driving a display which enables every display region of a display panel to successively display red, green, blue and black so as to reduce the influence of color breakup on human eyes.

As embodied and broadly described herein, the present invention provides a method for driving a display. The method includes following steps. First, a display panel is divided into a plurality of bright regions and a plurality of dark regions, wherein the plurality of dark regions and the plurality of bright regions are arranged alternately with each other so that the bright regions within a display panel are not adjacent to each other. Next, a full-color frame is divided into four sub-frames sequentially displayed in a time axis, wherein the four sub-frames are one by one corresponding to four color-orders in a space axis, and the display panel thereby randomly displays the four sub-frames during a frame period.

In addition, the step for displaying the i-th sub-frame includes: moving the above-mentioned plurality of dark regions in an adjustment direction so as to re-arrange the dark regions into a plurality of specific dark regions thereon and the bright regions into a plurality of specific bright regions thereon; providing the image data corresponding to the i-th color-order to the specific bright regions; and providing the backlight corresponding to the i-th color-order to the specific bright regions, wherein each of the specific dark regions on the i-th sub-frame provides black image, and i is an integer and $1 \leqq i \leqq 4$.

As embodied and broadly described herein, the present invention also provides a method for driving a display. The method includes following steps. First, a display panel is divided into a plurality of bright regions and a plurality of dark regions, wherein the plurality of dark regions and the plurality of bright regions are arranged alternately with each other so that the bright regions are not adjacent to each other. Next, a full-color frame is divided into four sub-frames sequentially-displayed in a time axis, wherein the four sub-frames are one by one corresponding to four color-orders in the space axis, and the sub-frames are divided into a first group and a second group which are sequentially displayed during a first frame period and a second frame period so that the sub-frames are successively appeared on the display panel.

The step for displaying a i-th sub-frame includes: moving every dark region of every sub-frame in an adjustment direction so as to re-arrange the dark regions into a plurality of specific dark regions thereon and the bright regions into a plurality of specific bright regions thereon; providing the image data corresponding to the i-th color-order to the specific bright regions; and providing the backlight corresponding to the i-th color-order to the specific bright regions, wherein each of the specific dark regions on the i-th sub-frame provides black image, and i is an integer and $1 \leqq i \leqq 4$.

Since the present invention adopts a scheme to disturb the arrangement of the colors in the time axis and space axis so that every display region on a display panel is able to successively display red, green, blue and black, which further improve the influence of color breakup on human eyes.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
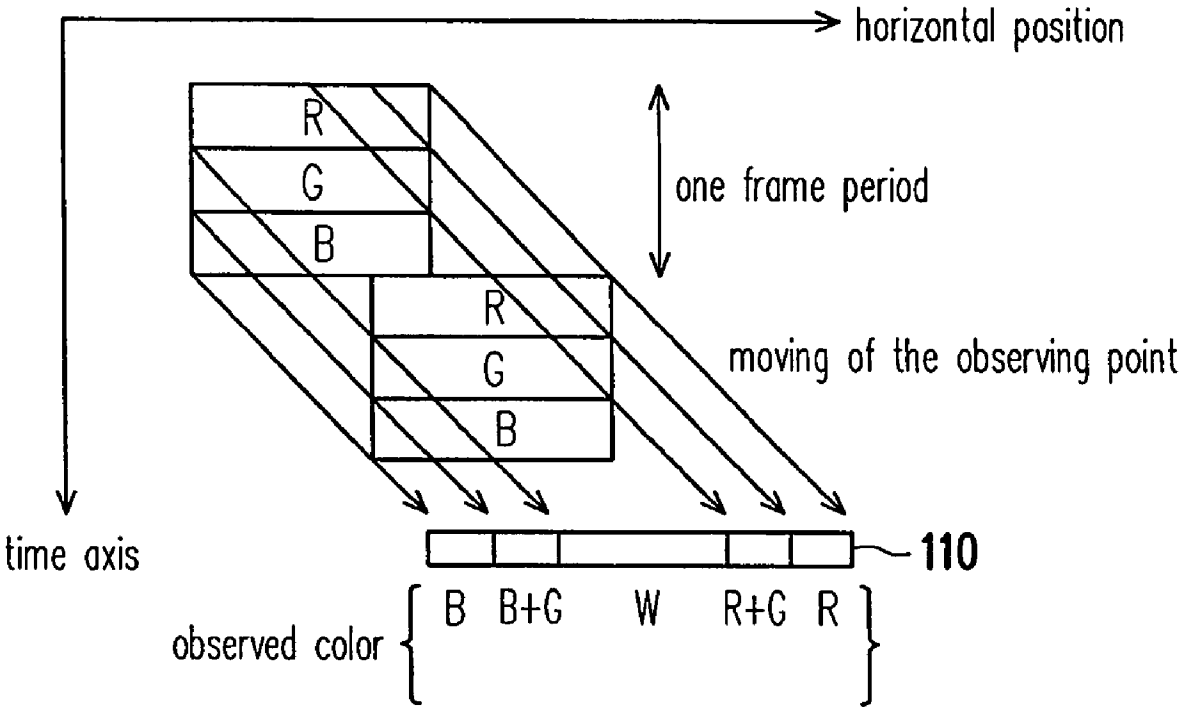
FIG. 1A(PRIOR ART)
FIG. 1A is a diagram showing color breakup phenomenon.
Figure 1B:
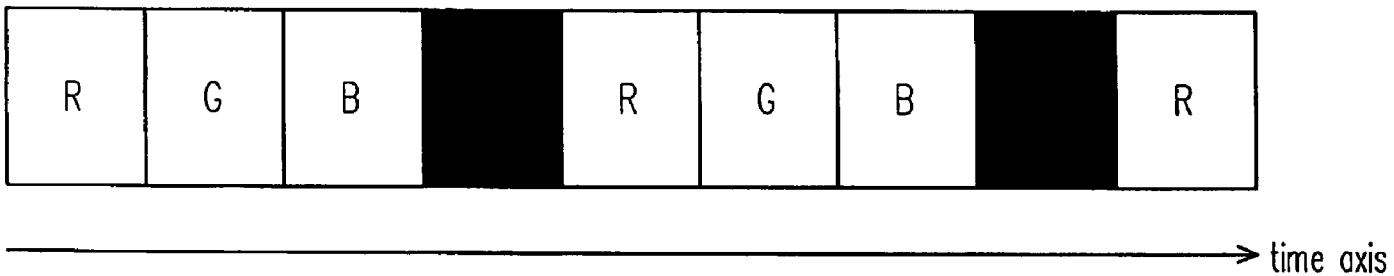
FIG. 1B(PRIOR ART)
FIGS. 1B and 1C illustrate flowchart diagrams of the prior art.
Figure 1C:
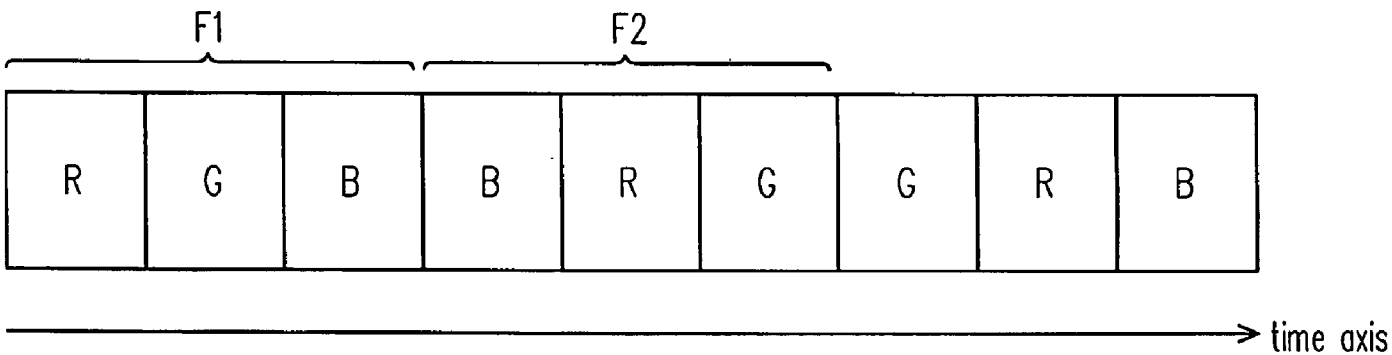
FIG. 1C(PRIOR ART)

Reference will now be made in detail to the present preferred embodiments of the invention, examples of which are illustrated in the accompanying drawings. Wherever possible, the same reference numbers are used in the drawings and the description to refer to the same or like parts.

The following depiction of the embodiments is based on the assumptions that the display adopting the method of the present invention is a liquid crystal display (LCD), the display panel is an LCD panel and full-color frames are displayed in 60 frames per second of frame rate, and the above-mentioned LCD uses light-emitting diodes (LEDs) as the backlight source and the LED emits, for example, red light (R), green light (G) and blue light (B). Based on the above-mentioned assumptions, a full-color frame is normally displayed in 1/60 second, during which the corresponding red image data, green image data and blue image data are sent to the LCD panel together with providing the corresponding red backlight, green backlight and blue backlight, and the time required to display a frame is termed as a frame period.

Anyone skilled in the art would understand that the above-mentioned frame period could be varied with a different frame rate. In addition, except for the above-mentioned LEDs, the currently available technology allows to use different backlight sources although the future backlight sources are uncertain, therefore, the present invention does not limit the above-mentioned LEDs as such.

Figure 2:
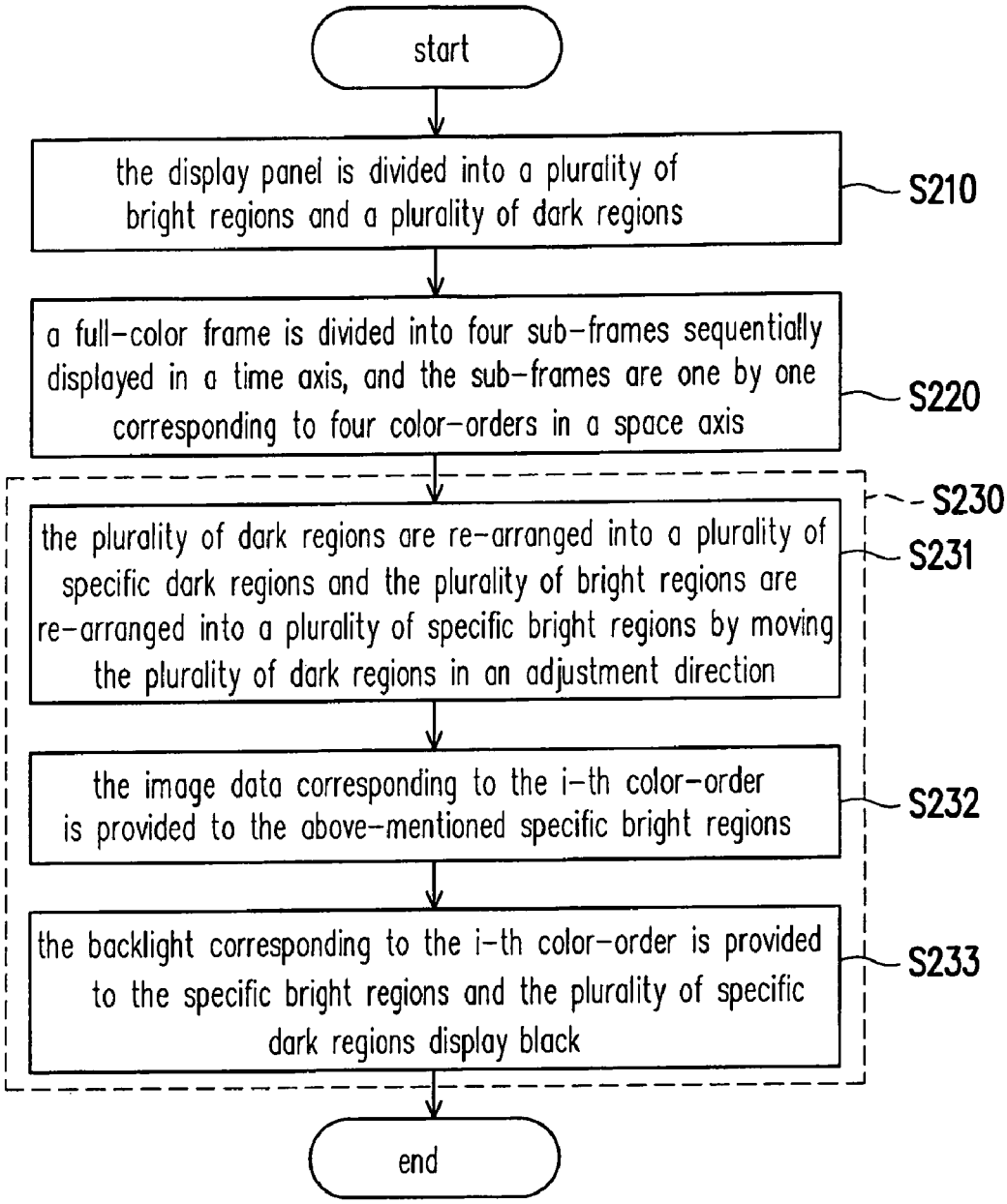
FIG. 2 is a flowchart diagram of a method for driving a display according to an embodiment of the present invention.

FIG. 2 illustrates a flowchart diagram of the method for driving a display according to an embodiment of the present invention. Referring to FIG. 2, first in step S210, a display panel is divided into a plurality of bright regions and a plurality of dark regions, wherein the plurality of dark regions and the plurality of bright regions are arranged alternately with each other so that the bright regions within the display panel are not adjacent to each other. In addition, the arrangement pattern of the above-mentioned dark regions includes a first arrangement pattern and a second arrangement pattern.

Figure 3:
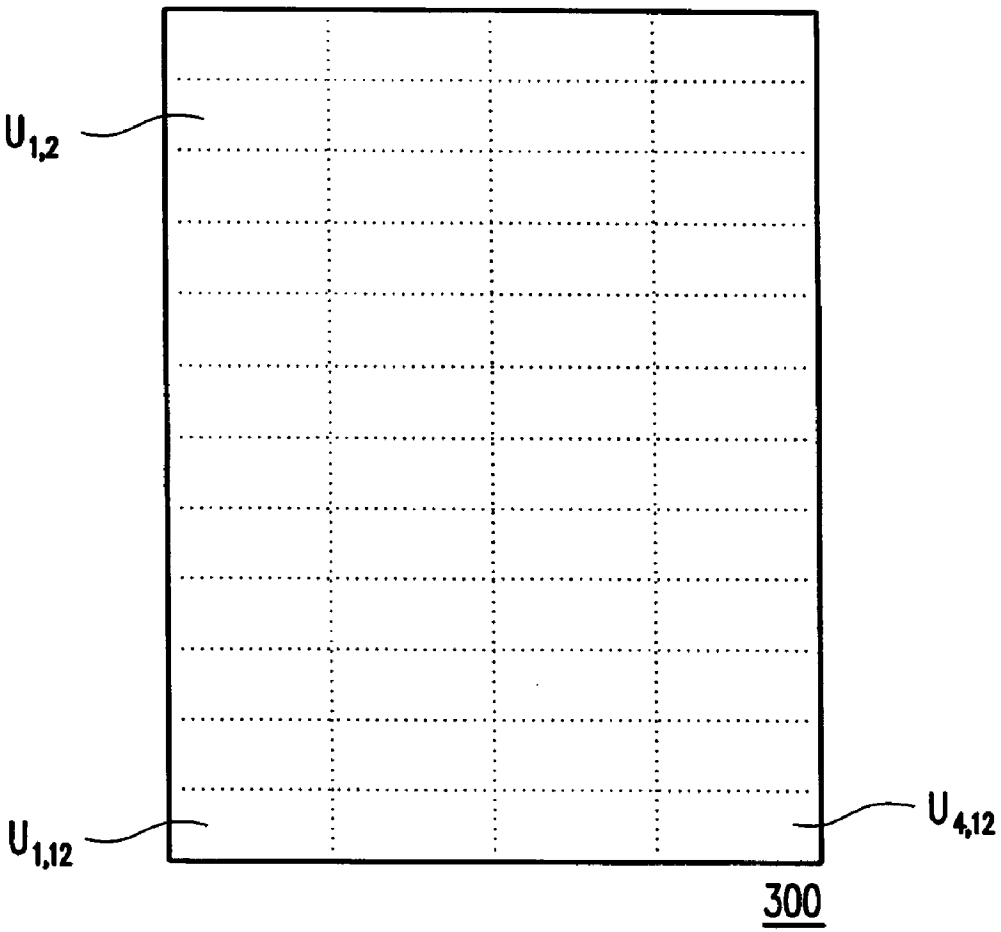
FIG. 3 is a display panel diagram to illustrate the embodiment of FIG. 2.

Taking the display panel of FIG. 3 as an example, during the formation of the bright regions and the dark regions. First, the display panel 300 is divided into four longitudinal zones and each longitudinal zone includes twelve display regions notated by $U_{x,y}$, wherein X, Y are the positive integers, $1 \leqq X \leqq 4$, $1 \leqq Y \leqq 12$. For example, the first longitudinal zone includes display regions $U_{1,1}$-$U_{1,12}$, wherein the display region $U_{1,2}$ represents the second display region in the first longitudinal zone, the display region $U_{4,12}$ represents the twelfth display region in the fourth longitudinal zone, and so on.

Prior to combining the display regions within the display panel into backlight regions and dark regions, it needs to be considered that the dark regions within the display panel have two arrangement patterns, the first arrangement pattern and the second arrangement pattern. During the combination of the display regions into backlight regions or dark regions, only one of the first arrangement pattern and the second arrangement pattern is selected, and the selected one is termed as a specific arrangement pattern.

Figure 4A:
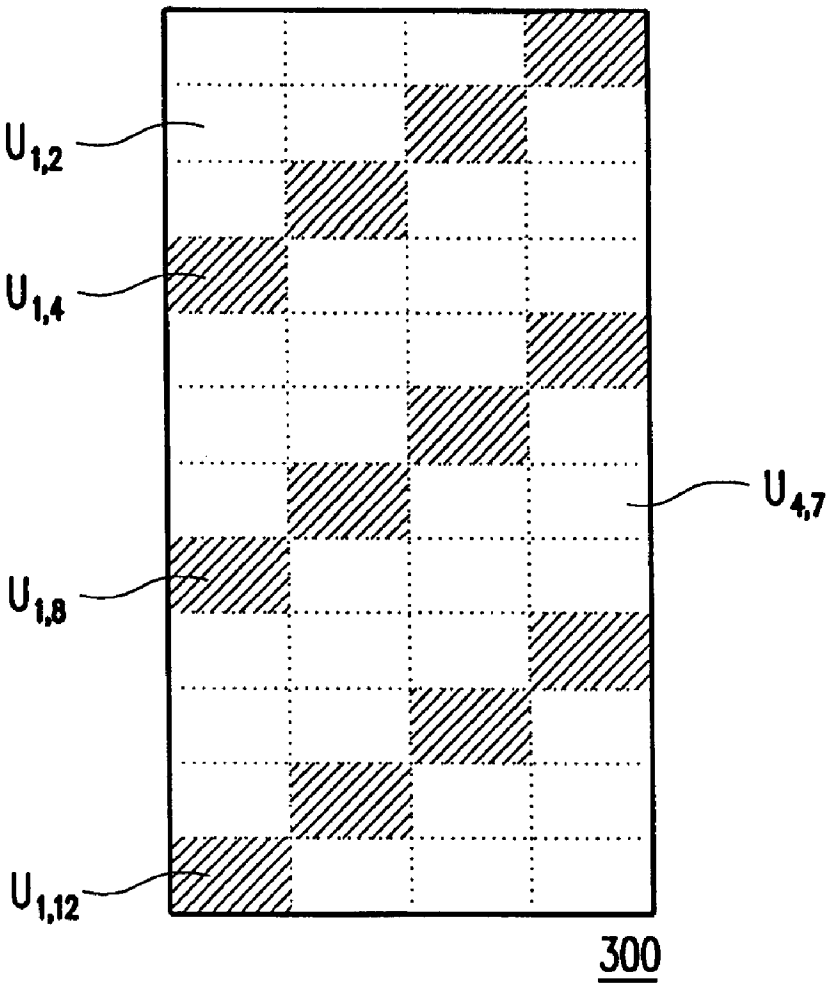
FIGS. 4A and 4B are diagrams showing the display regions of a display panel having a first arrangement pattern.

Taking the first arrangement pattern as an example, the display panel 300 of FIG. 3 is converted into FIG. 4A. Referring to FIG. 4A, the (5−i)-th, (9−i)-th, (13−i)-th, . . . , (4N+1−i)-th display regions in the i-th longitudinal zone are respectively considered as a sub-dark region and they are respectively termed as the first sub-dark region, the second sub-dark region, the third sub-dark region, . . . in the i-th longitudinal zone, wherein N and i are integers, and $1 \leqq i \leqq 4$. For example, display regions $U_{1,4}$, $U_{1,8}$ and $U_{1,12}$ respectively represent the first sub-dark region, the second sub-dark region and the third sub-dark region in the first longitudinal zone.

Figure 4B:
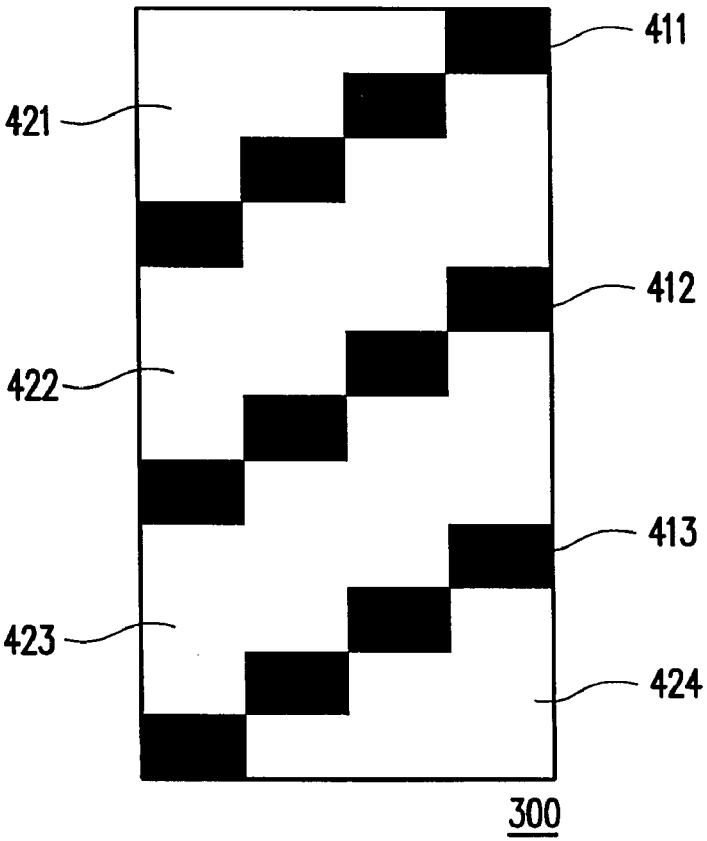

Next, all the first sub-dark regions in all the longitudinal zones including the first longitudinal zone to the fourth longitudinal zone in FIG. 4A are combined together into a first dark region 411 shown by FIG. 4B. Similarly, all the second sub-dark regions in the first longitudinal zone to the fourth longitudinal zone are combined together into a second dark region 412, until a third dark region 413 is obtained. Referring to FIG. 4B, within the rest of the regions of the display panel 300 without the dark regions 411-413, the adjacent display regions are combined together into bright regions 421-424.

Note that the dark region 411 is located between the bright regions 421 and 422, the dark region 412 is located between the bright regions 422 and 423 and analogically for the dark region 413. In other words, the bright regions 411-413 and the dark regions 421-424 are alternately arranged which enables the bright regions 421-424 within the display panel 300 are not adjacent to each other and the area ratio of all the bright regions 421-424 over all the dark regions 411-413 is 3:1.

Figure 5A:
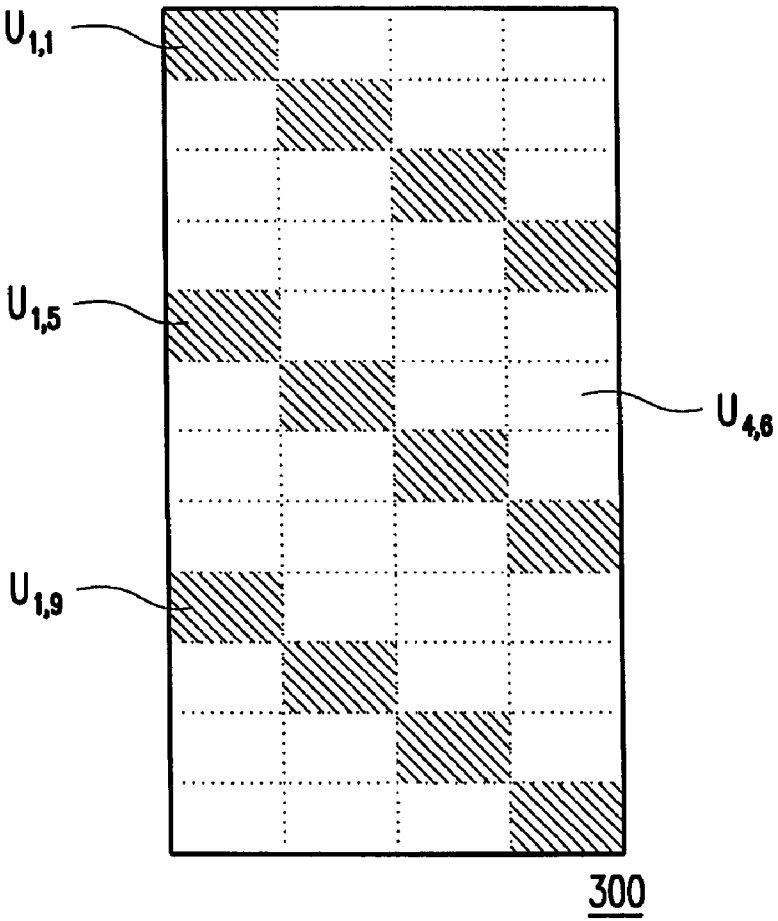
FIGS. 5A and 5B are diagrams showing the display regions of a display panel having a second arrangement pattern.
Figure 5B:
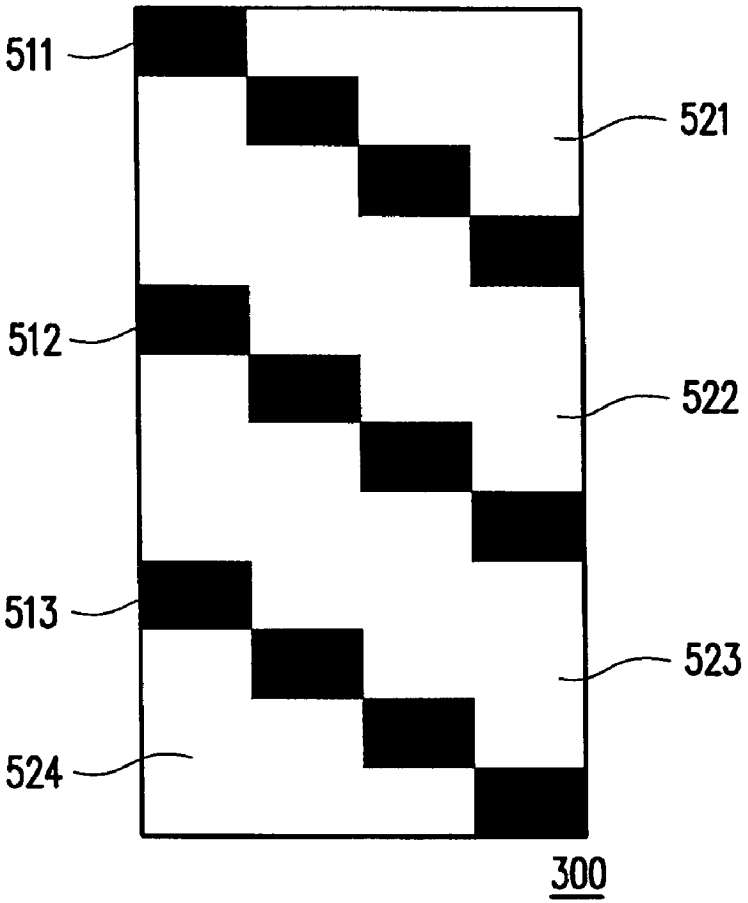

When taking the second arrangement pattern, the display panel 300 of FIG. 3 is similarly converted into FIG. 5A. Referring to FIG. 5A, the i-th, (i+4)-th, (i+8)-th, . . . , (i+4N)-th display regions in the i-th longitudinal zone are respectively considered as a sub-dark region and they are sequentially termed as the first sub-region, the second sub-region, the third sub-dark region, . . . in the i-th longitudinal zone. After that, all the first sub-dark regions in all the longitudinal zones including the first longitudinal zone to the fourth longitudinal zone in FIG. 5A are combined together into a first dark region 511 shown by FIG. 5B. Similarly, all the second sub-dark regions in the first longitudinal zone to the fourth longitudinal zone are combined together into a second dark region 512, until a third dark region 513 is obtained.

Referring to FIG. 4B, within the rest of the regions of the display panel 300 without the dark regions 511-513, the adjacent display regions are combined together into bright regions 521-524. The bright regions 511-513 and the dark regions 521-524 herein are alternately arranged so that the bright regions 521-524 within the display panel 300 are not adjacent to each other and the area ratio of all the bright regions 521-524 over all the dark regions 511-513 is 3:1.

Continuing to refer FIG. 2, in step S220, after dividing the display panel into bright regions and dark regions, a full-color frame is completed by four sub-frames displayed in a time axis and the four sub-frames are one by one corresponding to four color-orders in a space axis. In step S230, the four sub-frames are randomly displayed during a frame period, wherein the step for displaying the i-th sub-frames includes following steps. First in step S231, by moving the plurality of dark regions in an adjustment direction, the plurality of dark regions is re-arranged into a plurality of specific dark regions and the plurality of bright regions is re-arranged into a plurality of specific bright regions. Next in step S232, the image data corresponding to the i-th color-order is provided to the above-mentioned specific backlight regions. Further in step S233, the backlight corresponding to the i-th color-order is provided to the specific bright regions and the plurality of specific black regions provides black images.

Figure 6:
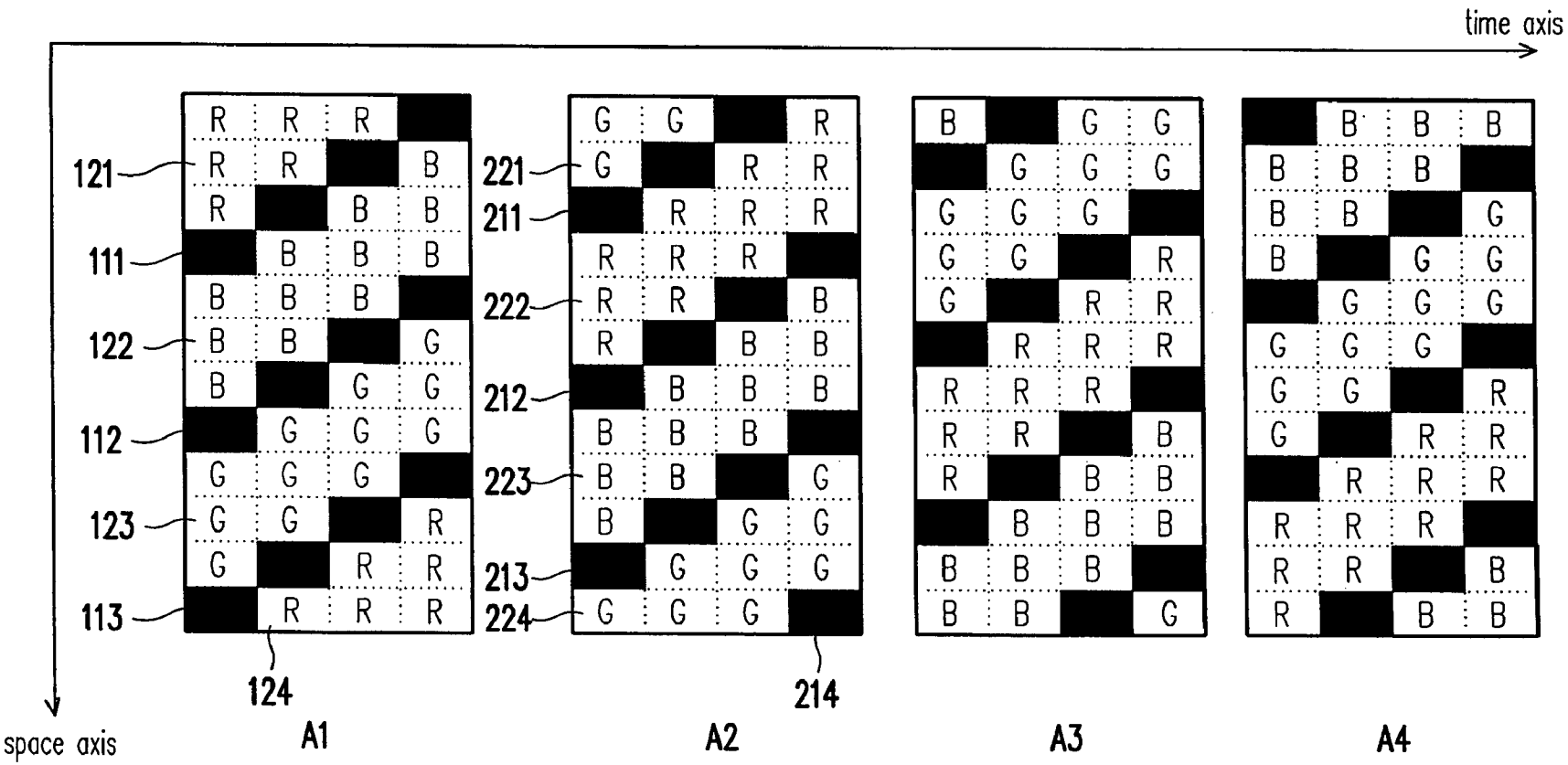
FIG. 6 illustrates a flowchart diagram for a display panel to randomly display four sub-frames.

FIG. 6 illustrates a flowchart diagram for a display panel to randomly display four sub-frames and the embodiment of FIG. 6 is exemplarily based on a first arrangement pattern. Referring to FIG. 6, after dividing the display panel into a plurality of bright regions and a plurality of dark regions, a full-color frame is divided into four sub-frames A1-A4 in a time axis, wherein each sub-frame takes 1/240 second to be displayed. The four sub-frames A1-A4 are formed by moving up or moving down all the dark regions by M display regions (M is a positive integer) so as to renew the places of the dark regions, which is used for dividing a full-color frame into four sub-frames.

For example, when all the dark regions in the sub-frame A1 are moved up by a display region, the original dark regions 111-113 in the sub-frame A1 are re-arranged into a plurality of specific dark regions, i.e. the dark regions 211-214 in the sub-frame A2. Accordingly, the original bright regions 121-124 in the sub-frame A1 are re-arranged into a plurality of specific bright regions, i.e. the bright regions 221-224 in the sub-frame A2, and analogically for the dark regions and the bright regions in the sub-frames A3 and A4.

Next, the four sub-frames A1-A4 are respectively assigned by one of four color-sequences. With the first color-sequence is arranged circularly by red-blue-green sequence in the space axis, the course of displaying the sub-frame A1 includes: providing the image data corresponding to red to the bright region 121 and providing the image data corresponding to blue to the bright region 122, analogically for the bright regions 123 and 124; and providing blue backlight to the bright region 122 when all the bright regions 121-124 receive the corresponding image data, providing red backlight to the bright region 121, providing blue backlight to the bright region 122, and analogically for the bright regions 123 and 124. At this point, the dark regions 111-113 provide black images.

Similarly, with the second color-sequence is arranged circularly by red-blue-green sequence in the space axis, and the third and fourth color-sequences are arranged circularly by blue-green-red sequence in the space axis, the course of displaying the sub-frame A2 as shown by FIG. 6 includes: respectively providing the image data corresponding to green, red, blue and green to the bright regions 221-224; respectively providing green, red, blue and green backlight to the bright regions 221-224 when all the image data are received. At the point, the dark regions 211-214 provide black images. Analogically for the sub-frames A3 and A4, the bright regions thereof would receive corresponding image data and backlight.

In this way, a set of four sub-frames A1-A4 (termed as A set of sub-frames hereinafter) in the first arrangement pattern is obtained, and each display region in a full-color frame composed of A set of sub-frames gives red display, green display and blue display during a frame period.

Figure 7:
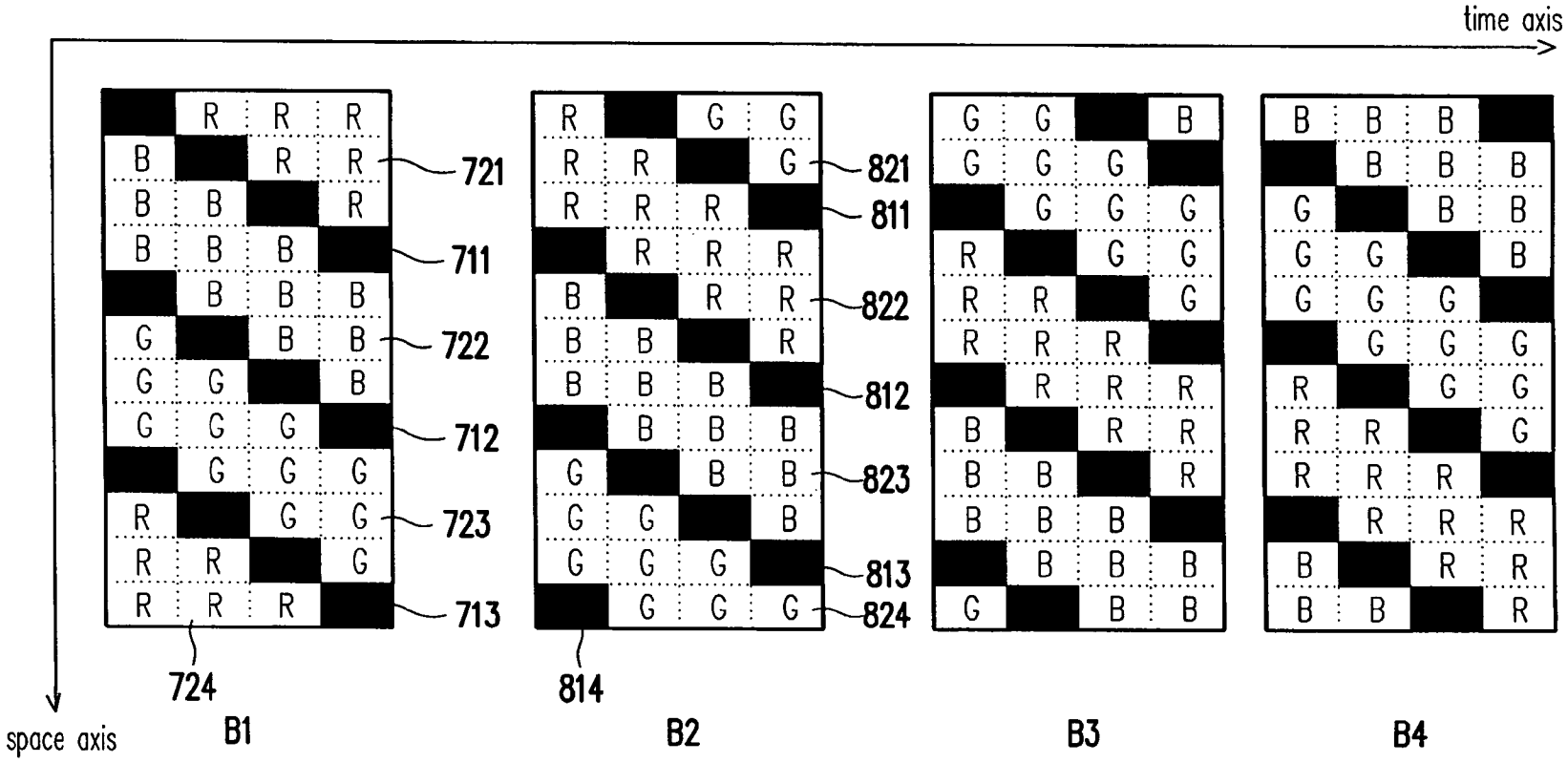
FIG. 7 illustrates another flowchart diagram for a display panel to randomly display four sub-frames.

FIG. 7 illustrates another flowchart diagram for a display panel to randomly display four sub-frames. Referring to FIG. 7, the display panel thereof takes a second arrangement pattern. Similarly to the embodiment of FIG. 6, four sub-frames B 1 -B4 in FIG. 7 are formed by moving up or moving down all the dark regions by M display regions (M is a positive integer) so as to renew the places of the dark regions, which is used for dividing a full-color frame into four sub-frames. For example, when all the dark regions in the sub-frame B1 are moved up by a display region, the original dark regions 711-713 in the sub-frame B1 are re-arranged into a plurality of specific dark regions, i.e. the dark regions 811-814 in the sub-frame B2. Accordingly, the original bright regions 721-724 in the sub-frame B1 are re-arranged into a plurality of specific bright regions, i.e. the bright regions 821-824 in the sub-frame B2.

After that, the four sub-frames B1-B4 are respectively assigned by one of four color-sequences (the same as the color-sequences in FIG. 6) for display. For displaying the sub-frame B1, the bright regions 721-724 respectively receive red, blue, green and red display data and the backlight thereof, while dark regions 711-713 provide black images, and analogically for the sub-frames B2-B4. In this way, a set of four sub-frames B1-B4 (termed as B set of sub-frames hereinafter) in the second arrangement pattern is obtained, and each display region gives red display, green display and blue display during a frame period.

It should be noted that in the two sets of sub-frames (A set and B set) in the embodiments of FIGS. 6 and 7, four sub-frames of each set can be displayed in a random sequence or in a specific display-sequence. For example, the four sub-frames in A set and/or in B set can be displayed in a random display-sequence during a frame period. In other words, for example, for the A set of sub-frames shown by FIG. 6, the sub-frames A1-A4 can have 24 display-sequences, for example, A1A2A3A4, A1A4A2A3 and A2A4A3A1, etc. The sub-frames A1-A4 can be randomly displayed in one of the above-mentioned 24 display-sequences. Similarly, the four sub-frames in A set and/or in B set can be displayed in a specific display-sequence during a frame period, wherein the above-mentioned specific display-sequence can be, for example, A1A2A3A4, and analogically for the B set of sub-frames shown by FIG. 7. In addition, two sets of sub-frames, A set and B set, are allowed to be alternately displayed for a plurality of full-color frames. For example, when two full-color frames are displayed on a display panel, the first full-color frames can use the A set of sub-frames for displaying, while the second full-color frames can use the B set of sub-frames for displaying. In other words, A set of sub-frames and B set of sub-frames can be alternately displayed in the following display-sequences: A set (A1A2A3A4)-B set (B1B2B3B4)-A set (A1A2A3A4)-B set (B1B2B3B4), and so on, wherein the sub-frames of the A set and the B set are displayed for a full-color frame respectively in a specific sequence, for example A1A2A3A4 and B1B2B3B4.

Figure 8:
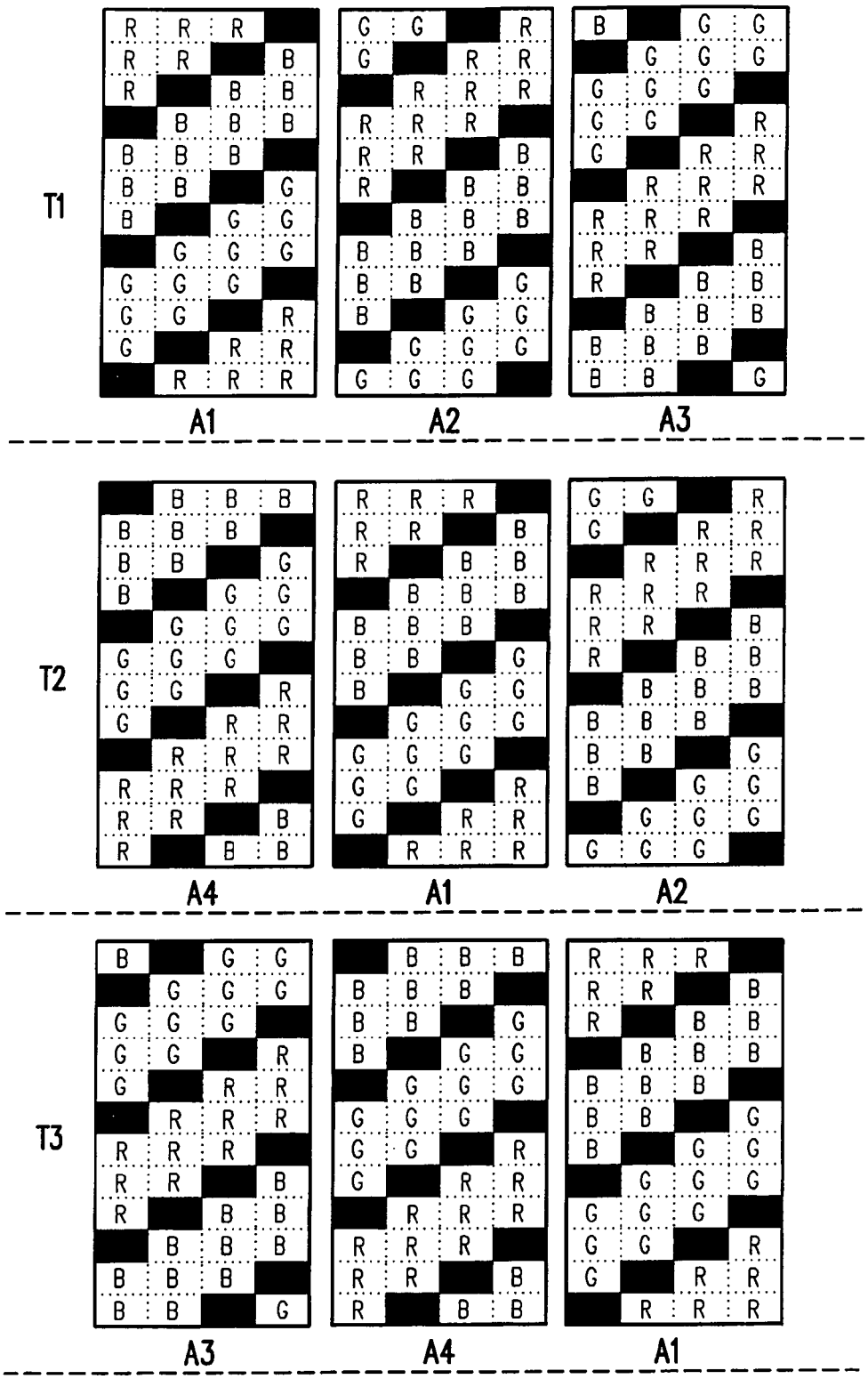
FIG. 8 illustrates a flowchart diagram for a display panel to display four sub-frames in sequentially cycling mode.

FIG. 8 is a displaying flowchart diagram for a display panel divided into groups to sequentially display four sub-frames, wherein the present embodiment is exemplarily described by taking the above-mentioned A set of sub-frames as an example. Referring to FIG. 8, during frame periods T1 and T2, the sub-frames A1-A4 are divided into a first group and a second group, wherein the first group includes the sub-frames A1-A3, while the second group includes the sub-frame A4 only. In order to successively display the sub-frames A1-A4 in a time axis on the display panel, the first group (the sub-frames A1-A3) and the second group (the sub-frame A4) are sequentially displayed, wherein during the frame period T1, the sub-frames A1-A3 in the first group are randomly displayed on the display panel.

Next, during the frame periods T2 and T3, the sub-frames A1-A4 are divided into a first group and a second group as well, wherein the first group includes the sub-frames A1-A2, while the second group includes the sub-frames A3-A4. Similarly in order to successively display the sub-frames A1-A4 in a time axis on the display panel, after displaying the sub-frames A1-A2 during the frame period T2, the sub-frames A3-A4 are displayed during the frame period T3, wherein during the frame periods T2 and T3, the sub-frames A1-A2 in the first group and the sub-frames A3-A4 in the second group are randomly displayed on the display panel. In other words, only three sub-frames are displayed during each frame period in the embodiment, and the display time of each sub-frame is increased to 1/180 second. For example, during the frame period T1, the sub-frames A1, A2 and A3 are displayed, while during the frame period T2, the sub-frames A4, A1 and A2 are displayed.

Continuing to refer to FIG. 8, the present embodiment features making each display region in the sub-frames successively is displayed with red (R), green (G), blue (B) and black. In this way, the above-described mode for displaying four sub-frames during a frame period is replaced by displaying three sub-frames during a frame period. For example, it is defined that the frame period T1 corresponds to the sub-frames A1A2A3, the frame period T2 corresponds to the sub-frames A4A1A2 and the frame period T3 corresponds to the sub-frames A3A4A1. Thus, a display region, for example $U_{4,1}$, is displayed with black, red (R) and green (G) during the frame period T1, and then is displayed during the frame period T2 with blue (B) of the sub-frame A4 and blue is lacked for the display region $U_{4,1}$. At this point, thanks to the persistence effect of human eye's vision, the sequentially appeared sub-frames A1A2A3A4 during the frame periods T1 and T2 are perceived by human's eyes as a full-color frame. In other words, the embodiment uses two sequential frame periods to alternately display the sub-frames A1A2A3A4, and achieve the goal of displaying a full-color frame by three sub-frames. The detail of the embodiment of FIG. 8 can be referred to the above-described embodiments and the description thereof is omitted for simplicity.

In summary, the present invention is applied to a display without color filters having extreme low optical transmittance, therefore, the present invention is able to significantly increase optical transmittance and makes color display more vivid. Compared to the prior art, the present invention uses four sub-frames in the time axis and four color-orders corresponding to the sub-frames in a space axis to disturb the arrangement of the colors constituting the full-color frame. In addition, the present invention uses a scheme of black-inserting and randomly assigns display-sequences to improve color breakup phenomena.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for driving a display with a display panel and a backlight module, comprising:

dividing the display panel into a plurality of bright regions and a plurality of dark regions, wherein the dark regions and the bright regions are alternately arranged;

dividing a full-color frame into four sub-frames sequentially displayed in a time axis, wherein the sub-frames are one by one corresponding to four color-orders in a space axis; and randomly displaying the sub-frames during a frame period on the display panel, wherein the step of displaying an i-th sub-frame comprises:

moving the dark regions of the display panel in an adjustment direction so that the dark regions are re-arranged into a plurality of specific dark regions and the bright regions are re-arranged into a plurality of specific bright regions;

providing the image data corresponding to an i-th color-order to the specific bright regions of the display panel; and providing the backlight corresponding to the i-th color-order to the specific bright regions through the backlight module and displaying the specific dark regions of the display panel with black, wherein i is an integer and $1<i<4$.

2. The method for driving the display according to claim 1, wherein the first color-order is arranged circularly by red-blue-green sequence in the space axis, the second color-order is arranged circularly by green-red-blue sequence in the space axis, and the third and fourth color-orders are arranged circularly by blue-green-red sequence in the space axis.

3. The method for driving the display according to claim 1, wherein arrangement patterns of the dark regions comprise a first arrangement pattern and a second arrangement pattern.

4. The method for driving the display according to claim 3, wherein the step of dividing a display panel into a plurality of bright regions and a plurality of dark regions comprises:

dividing the display panel into four longitudinal zones, wherein each of the longitudinal zones comprises a plurality of display regions;

selecting one of the first arrangement pattern and the second arrangement pattern as a specific arrangement pattern;

wherein when the arrangement pattern is the first arrangement pattern, a (5-i)-th, a (9-i)-th, a (13-i)-th,. . . , a (4N+1-i)-th display regions in an i-th longitudinal zone are respectively considered as a sub-dark region, wherein N is a positive integer;

wherein when the arrangement pattern is the second arrangement pattern, an i-th, an (i+4)-th, an (i+8)-th,. . . , an (i+4N)-th display regions in the i-th longitudinal zone are respectively considered as a sub-dark region;

sequentially combining a j-th sub-dark region in four longitudinal zones to form a j-th dark region, wherein j is an integer and $1<j<N$; and combining the display regions adjacent to each other into the bright regions regardless of the dark regions.

5. The method for driving the display according to claim 4, wherein the step of moving the dark regions in an adjustment direction comprises:

moving up or down each of the sub-dark regions in the i-th longitudinal zone by M display regions, wherein M is a positive integer.

6. The method for driving the display according to claim 3, further comprising:

dividing a first full-color frame into four sub-frames having the first arrangement pattern;

dividing a second full-color frame into four sub-frames having the second arrangement pattern; and making the display panel alternately display the first full-color frame and the second full-color frame.

7. The method for driving the display according to claim 6, wherein the step of making the display panel display the first full-color frame comprises:

randomly displaying the four sub-frames having the first arrangement pattern or displaying the four sub-frames having the first arrangement pattern in a first specific sequence to form the first full-color frame.

8. The method for driving the display according to claim 6, wherein the step of making the display panel display the second full-color frame comprises:

randomly displaying the four sub-frames having the second arrangement pattern or displaying the four sub-frames having the second arrangement pattern in a second specific sequence to form the second full-color frame.

9. The method for driving the display according to claim 1, wherein the display panel comprises a liquid crystal display panel.

* * * * *